United States Patent [19]

Sechen

[11] Patent Number: 4,766,780

[45] Date of Patent: Aug. 30, 1988

[54] AUTOMATIC CORKSCREW

[76] Inventor: Frank Sechen, 120 Havenside Dr., San Francisco, Calif. 94132

[21] Appl. No.: 99,049

[22] Filed: Sep. 21, 1987

[51] Int. Cl.[4] ..... B67B 7/04

[52] U.S. Cl. ..... 81/3.2

[58] Field of Search ..... 81/3.2, 3.33

[56] References Cited

U.S. PATENT DOCUMENTS 1,938,484 12/1933 Clarin .
1,988,971 1/1935 Maynz et al. .
2,004,211 6/1935 Munzinger .

FOREIGN PATENT DOCUMENTS 1952727 4/1979 Fed. Rep. of Germany ..... 81/3.2

*Primary Examiner*—Roscoe V. Parker
*Attorney, Agent, or Firm*—Townsend and Townsend

[57] ABSTRACT

An automatic corkscrew driven by a reversible motor is provided in which a threaded, cork penetrating auger first penetrates and thereafter extracts a cork from the braced top of a wine bottle. The platform, on which the auger is rotatably mounted, moves to and from a position of full penetration of the auger into the cork. A ball screw moves the platform and provides through a chain for rotation of a normally disengaged thrust closed clutch. Initially the platform moves downwardly to a position where the auger fully penetrates the cork. During this downward motion, the auger is thrust into engagement with the cork, closed the normally disengaged clutch and rotates the auger so that the auger flight advances into the cork at the same speed the platform descends. At full penetration, the platform trips a motor reversing switch and reverses direction and ascends. The normally disengaged clutch is opened. The auger thus remains stationary with respect to the cork. Withdrawal of the cork occurs with the cork engaged by the full length of the auger flight. When cork extraction is completed, conventional manual removal of the intact cork from the auger enables presentation of the cork with the wine to the consumer.

8 Claims, 3 Drawing Sheets

AUTOMATIC CORKSCREW

BACKGROUND OF THE INVENTION

This invention relates to corkscrews and more particularly to a corkscrew in which an auger first penetrates and thereafter extracts a cork from a wine bottle under power of a reversible electric motor.

DESCRIPTION THE PRIOR ART

Electric powered corkscrew are known. See U.S. Pat. No. 1,938,484 (Clarin). This cork pulling machine uses a continuously rotating auger which simultaneously threads and extracts the cork.

This type of cork extraction mechanism is preferably utilized with corks having a low length to width aspect ratio. With modern day wineries, corks of relatively long length to width ratios are utilized. Unfortunately, where an auger is used to both thread and extract a cork simultaneously, cork disintegration can occur. It is not uncommon for a customer to reject a bottle of wine because of a mangled cork.

Bung extractors for bear kegs are also known. See U.S. Pat. No. 1,988,971 (Maynz et al.) and U.S. Pat. No. 2,004,211 (Munzinger). In these devices, heavy braced barrels are penetrated by a motor driven auger. and thereafter a long lever is used to manually extract the bung. Extraction under power does not occur.

SUMMARY OF THE INVENTION

An automatic corkscrew driven by a reversible motor is provided in which a threaded, cork penetrating auger first penetrates and thereafter extracts a cork from the braced top of a wine bottle. The platform, on which the auger is rotatably mounted, moves to and from a position of full penetration of the auger into the cork. A ball screw moves the platform and provides through a chain for rotation of a normally disengaged thrust closed clutch. Initially the platform moves downwardly to a position where the auger fully penetrates the cork. During this downward motion, the auger is thrust into engagement with the cork closed the normally disengaged clutch and rotates the auger so that the auger flight advances into the cork at the same speed the platform descends. At full penetration, the platform trips a motor reversing switch and reverses direction and ascends. The normally disengaged clutch is opened. The auger thus remains stationary with respect to the cork. Withdrawal of the cork occurs with the cork engaged by the full length of the auger flight. When cork extraction is completed, conventional manual removal of the intact cork from the auger enables presentation of the cork with the wine to the consumer.

OTHER OBJECTS AND ADVANTAGES

An object of this invention is to emulate a corkscrew of the type wherein the auger is bearing mounted to a stationary bottle neck brace. During penetration of the cork, a platform follows the auger downwardly to a position of full penetration relative to the wine bottle neck. During cork extraction, when the platform is forcibly moved upwardly, the auger remains idle in the entrained cork. The full force between corkscrew and cork is thus devoted to extraction.

An advantage of this invention is that the automatic corkscrew is adapted for extracting corks having a high length to width ratio without undue cork disintegration.

Moreover, the disclosed corkscrew enables pulling of corks from mature wines wherein the breathing properties of the wine have subjected the cork to some deterioration. With an intact cork, a high degree of customer acceptance of wine occurs.

A further advantage of this invention is to provide an apparatus for fully automated extraction of the cork. In a restaurant environment, the disclosed automatic corkscrew allows a waiter to expend his energy at activities other than cork extraction. At the same time, the disclosed device enables the professional waiter to present the customer with an intact "healthy" cork that encourages acceptance of the wine.

BRIEF DESCRIPTION OF THE DRAWINGS

Other objects, features and advantages of this invention will become more apparent after referring to the accompanying drawings in which.

DESCRIPTION OF THE PREFERRED EMBODIMENT

In describing the invention, the structure will first be described. Thereafter, the operation will be set forth.

Figure 1:
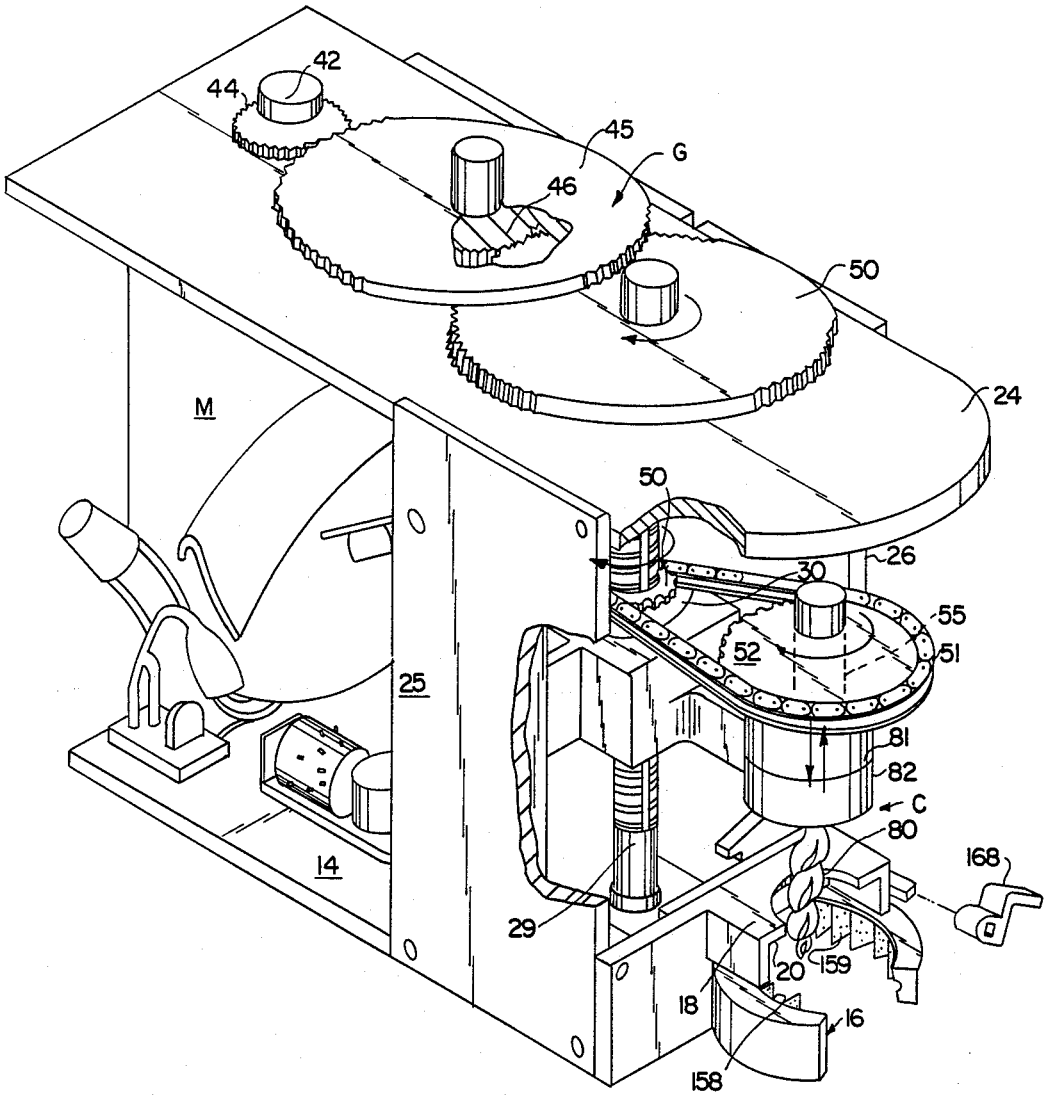
FIG. 1 is an elevational view of a preferred embodiment of this invention, shown without engagement of a wine bottle thereto.

Referring to FIG. 1, an automatic corkscrew C constructed in accordance with this invention is shown. Corkscrew C is supported by a base plate 14. Base plate 14 includes a bottle neck clamp 16. Overlying and attached to base plate 14 is a bottle stop pate 18. Bottle stop plate 18 has a bottle stop 20 attached thereto. As will be more apparent in the operation section of the specification, bottle stop 20 receives the lip of a bottle neck 22, preventing the bottle B from moving upwardly, while clamp 16 grips the neck 22 of the bottle, preventing transverse movement. It is from this braced disposition that the cork K is extracted.

It is necessary that the upper plate 24 be supported relative to the base plate 14. Side plates 25, 26 accomplish this function.

A guide shaft 29 and a ball screw 28 enable a platform P to move towards and away from bottle stop 20. Simply stated, a reversible motor M drives a ball screw shaft 29. Shaft 29 has following ball screw nut 30 on platform P follow threads on shaft 29. Upward and downward movement of platform P can occur.

Upper plate 24 supports reversible motor M. Motor M includes a rotating drive shaft 42 having a first drive gear 44 attached thereto. Drive gear 44 powers a reduction gear train G, resulting in the transmission of power to auger A and platform P.

First drive gear 44 powers a reduction gear set 45, 46. Gears 45, 46 are fastened together and rotate on a bearing surface 48 at the upper end of guide shaft 29. These gears reduce the shaft speed of motor M.

Finally, platform drive gear 50 meshes with gear 46 to provide rotation to threaded shaft 29.

Auger A is rotatably mounted in platform P at bearing 55. It is necessary to drive platform P along the frame F. Such movement occurs downwardly towards bottle B for insertion of the auger A into cork K. Movement of the platform must occur upwardly and away from bottle B for extraction of the cork K.

Auger A must be rotated during its downward movement. Consequently a platform drive sprocket 50 is keyed to threaded shaft 29. Drive sprocket 50 through chain 51 rotates auger sprocket 52.

During descending movement of platform P, auger A will penetrate cork K. When auger A penetrates cork K, it is necessary that the auger rotate.

Rotation of auger A during descending movement of platform P can be easily understood.

The gearing of respective sprockets 50, 52 is carefully selected with respect to the pitch of the flight 80 on auger A. Specifically, the auger flight 80 penetrates the cork at the same speed as the platform P descends. Thus, when the auger A penetrates the cork K. there will be no relative movement of the cork K.

The movement of extraction poses a different circumstance. Specifically, auger A must remain stationary with respect to cork K while platform P is raised.

A one way slip clutch 81 couples the auger A to sprocket 52. Clutch 81 engages the interior of sprocket 52 in a conventional manner. As it is apparent that reverse rotation of threaded shaft 29 is necessary for platform P to ascend, upon such reverse rotation, clutch 81 disengages sprocket 52 from auger A, enabling the auger to remain stationary with respect to cork K as platform P ascends.

Removal of the cork from auger A is done by hand. Specifically, the cork K on auger A is grasped, the lower portion of the clutch held steady in the hand, and the cork is unwound from the auger A.

The bottle clamping assembly and motor switching circuitry of the preferred embodiment will now be described. Bottle neck clamp 16 comprises bottle gripping jaws 158 and 159 which pivot about a mounting post (not shown) attached to base plate 14.

Figure 3:
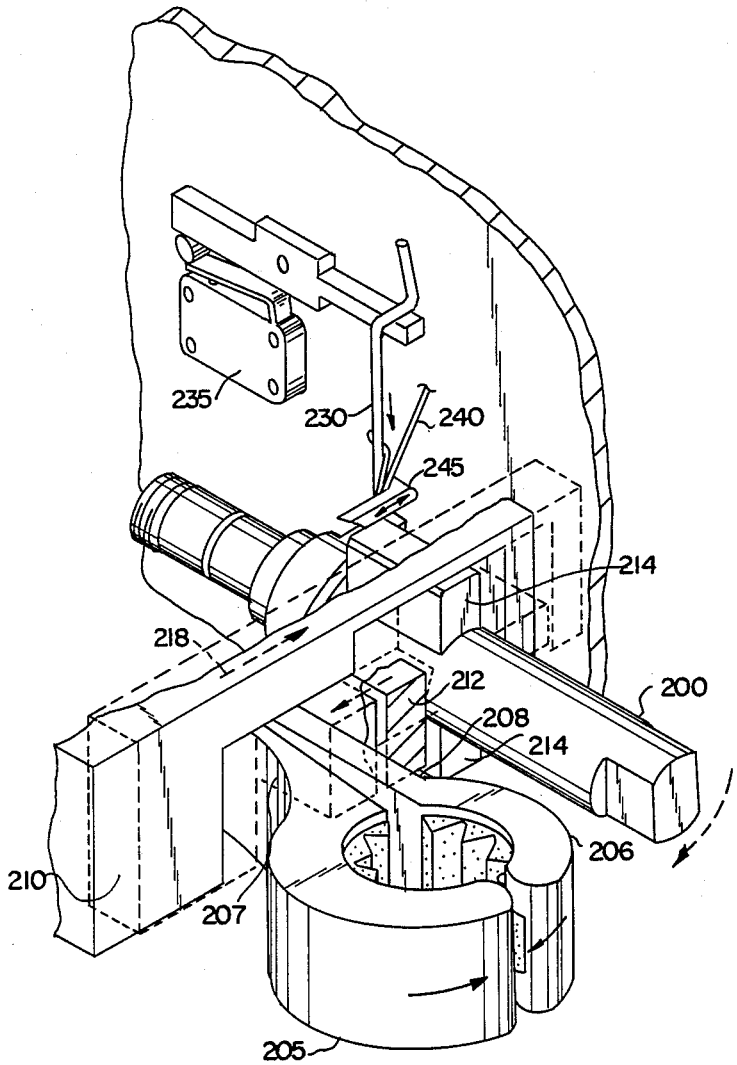
FIG. 3 is a perspective of the mechanism for the gripping of the neck of the bottle and switch network for starting, and reversing the motor to effect extraction of the cork.

Initial operation of the extractor may be understood with respect to the schematic of FIG. 3. This operation is initiated by the twisting of shaft 200. This twisting of the shaft 200 causes the bottle neck 22 to be gripped by opposed jaws 158, 159 and also starts motor M.

Jaws 158 and 159 each have an arcuate portion 205, 206 respectively which is disposed towards the bottle neck 22. These arcuate portions are supported on bar shafts 207, 208. The bar shafts 207, 208 are captured interior of a U shaped block 210 and a shim block 212. These two blocks cause bar shafts 207, 208 to move towards one another when shaft 200 is rotated. This movement is the direct result of the rotation of wings 214 attached to shaft 200. Such action is readily understood.

Presuming that shaft 200 rotates clockwise, upper wing 214 will contact the inside edge of U-shaped block 210. This contact will occur on that side of the U-shaped block that is remote from bar shaft 207. The U-shaped block will move in the direction of arrow 218.

When movement of the U-shaped block occurs, the opposite side of the U-shaped block will move toward bar shaft 207. Bar shaft 207 will be forced inwardly. As a result, arcuate portion will likewise be forced inwardly. Gripping of the bottle neck 22 on one side will occur.

Movement of the opposite side is analogous—but simpler. Specifically, bottom wing 24 will contact shim block 212. This will occur simultaneously with the movement of U-shaped block 210. Shim block 212 will move inwardly onto bar shaft 208. Bar shaft 208 will move inwardly forcing arcuate portion 206 inwardly on the bottle neck. Gripping of the bottle will occur.

Movement of shaft 200 also starts motor M. Specifically, an eccentric (not shown) pulls on wire 230 closing the toggle 235 to start motor M. Downward cork penetrating movement of the mechanism results.

When the auger has reached a position of full penetration into the cork, a wire 240 attached to the table (not shown in FIG. 3) hits motor reversing switch 245. The motor reverse and cork extraction occurs.

Having described in detail the construction of the preferred embodiment of this invention, its operation can be easily understood. A waiter inserts a bottle B in the automatic corkscrew C by bracing the lip of the bottle against bottle stop 20 with open jaws 158 and 159 on either side of the bottle neck 22. Jaws 158 and 159 are then closed around the bottle neck by rotating lever 168 clockwise 90°, which simultaneously causes power switch 182 to rotate motor M in a clockwise direction. Rotation of motor M in a clockwise direction causes threaded shaft 29 to rotate in a forward direction, through gear train G. This causes platform P to descend toward bottle neck 22, carrying with it auger A which rotates at a predetermined rate matched to the descent speed of platform P. Specifically, the rotational rate of auger A is governed by sprockets 50, 52 so that the descent speed of auger flight 80 equals the descent speed of platform P. Thus, auger A penetrates cork K without exerting any lifting force on the cork, minimizing the chance of cork disintegration.

When auger A comes into contact with cork K, the normally open clutch 81 closes. Auger A then rotates into full penetration of cork K.

Figure 2A:
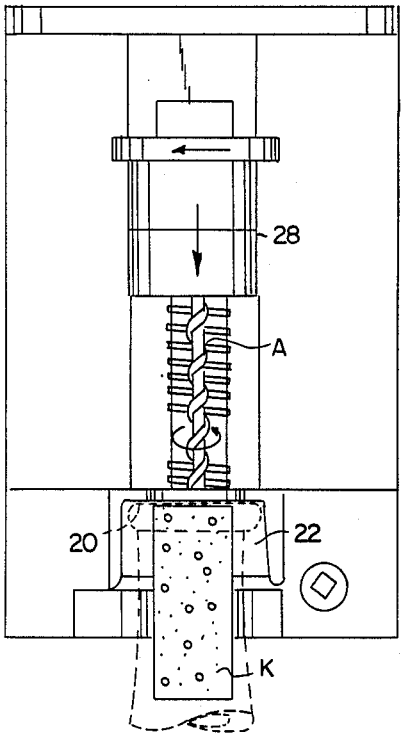
FIG. 2A is a detail illustrating the auger before penetrating a cork.
Figure 2B:
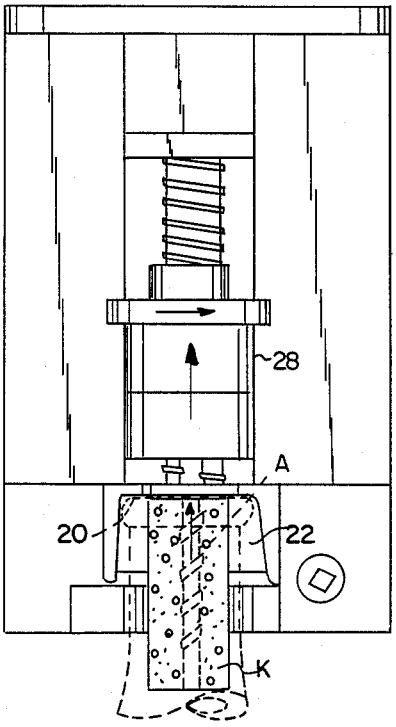
FIG. 2B is a detail similar to FIG. 2A, but illustrating the auger totally penetrating the cork.

When auger A has fully penetrated cork K (FIG. 2B), a reversing pin 184, carried by descending platform P, contacts reversing switch 186. Switch 186 causes motor M to rotate in a reverse direction. This causes platform P to ascend, moving away from bottle neck 22. During the ascent of platform P, clutch 81 disengages auger A from sprocket 52, so that the auger remains stationary with respect to cork K as the auger and cork are lifted out of the bottle B (FIG. 3).

When the cork has been fully extended, the waiter rotate lever 168 counterclockwise, turning off power to motor M and opening jaws 158, 159 so that the bottle B may be removed. The cork may then be manually removed from auger A for presentation to the customer, by grasping auger surface 82 and twisting the cork.

For the above description, it will be apparent that the subject matter of this invention is capable of taking various useful forms. For example, the downward movement of platform P may be accomplished without threaded shaft 20, using the pulling force of auger A on the bottle cork to power the platform's downward movement. Also, a bottle stop may be provided which accomplishes the described motor switching operation by turning the motor on when a waiter places the lip of a bottle neck 22 against the bottle stop and applies upward pressure. Accordingly, it is intended that this disclosure be taken in an exemplary sense, and that the scope of protection afforded be determined by the appended claims.

What is claimed is:

1. An automatic corkscrew for extracting a cork from the neck of a wine bottle comprising in combination:

a rigid frame;

a bottle stop mounted in said frame for securely bracing the neck of said bottle relative thereto;

a platform mounted for guided movement within said frame toward and away from said braced bottle neck;

an auger rotatably mounted to said platform and having a flight for penetrating said cork of said braced wine bottle during movement of said platform toward said bottle neck;

a ball screw including a threaded shaft and a ball nut for following said threaded shaft, said ball nut attached to said platform;

a reversible motor for driving said thread shaft during penetration and removal of said cork;

auger rotating means coupling said motor to said auger for rotating said auger flight during movement of said platform towards and away from said braced bottle neck;

clutch means for disengaging said auger from powered rotation during movement of said platform away from said bottle neck, whereby said auger entrains said cork with stationary auger flight to permit removal of said cork.

2. An automatic corkscrew according to claim 1 wherein said auger rotating means comprises means for rotating said auger at a speed which matches the movement of said auger flight to the speed at which said platform approaches said bottle neck.

3. An automatic corkscrew according to claim 1 and including electrical switching means for reversing the direction of motor rotation when said platform reaches a predetermined position with respect to said bottle stop.

4. An automatic corkscrew according to claim 1, wherein said auger rotating means rotates said auger flights in response to rotation of said motor in a first direction and further comprising:

a pair of opposed jaws having a receiving portion adapted to securely grip the neck of said bottle in a closed position;

means for opening and closing said jaws about the neck of said bottle; and control means responsive to closing of said jaws for rotating said motor in said forward direction.

5. An automatic corkscrew according to claim 1, further comprising reverse switching means for rotating said motor in a reverse direction in response to full penetration of said cork by said rotating auger, said platform driving means being responsive to said reverse motor rotation for driving said platform away from said bottle neck.

6. An automatic corkscrew according to claim 4 wherein said control means further comprises means responsive to opening of said jaws for stopping the rotation of said motor.

7. An automatic corkscrew according to claim 1, wherein said disengaging means comprises a one-way slip clutch coupled to said auger.

8. A corkscrew of the type wherein an auger is bearing mounted to a bottle neck brace and is rotated in said bearing during penetration of the auger into the cork and bottle neck, and the auger and cork are thereafter moved out of the bottle neck against the resistance of said brace while the auger is stationary with respect to the cork, to permit extraction of the cork, the improvement comprising:

a platform having said auger rotatably mounted thereto;

a reversible electric motor having connected gearing for powering said platform to move toward said bottle neck during rotation of said motor in a forward direction and away from said bottle neck during rotation of said motor in a reverse direction;

switching means for reversing said motor when said auger has fully penetrated said cork; and clutch means connected between said gearing and auger for rotating said auger to penetrate said cork during descent of said platform and idling said auger to permit withdrawal of said cork during ascent of said platform.

* * * * *